US008496014B2

(12) United States Patent
Bown et al.

(10) Patent No.: US 8,496,014 B2
(45) Date of Patent: Jul. 30, 2013

(54) CLEANING DEVICE

(75) Inventors: Gavin Bown, Bournville (GB); Paul Duffield, Hull (GB); Steve Walsh, Hull (GB)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 1114 days.

(21) Appl. No.: 12/444,619

(22) PCT Filed: Oct. 1, 2007

(86) PCT No.: PCT/GB2007/003701

§ 371 (c)(1),
(2), (4) Date: May 12, 2009

(87) PCT Pub. No.: WO2008/047073

PCT Pub. Date: Apr. 24, 2008

(65) Prior Publication Data

US 2009/0293921 A1 Dec. 3, 2009

(30) Foreign Application Priority Data

Oct. 18, 2006 (GB) ..... 0620676.7

(51) Int. Cl.
*B08B 3/04* (2006.01)
*B65D 83/30* (2006.01)

(52) U.S. Cl.
USPC ..... 134/104.2; 134/198; 222/635

(58) Field of Classification Search
USPC ..... 134/104.2, 198; 222/635
See application file for complete search history.

(56) References Cited

U.S. PATENT DOCUMENTS

| | | | | |
|---|---|---|---|---|
| 2,611,650 | A * | 9/1952 | Palm | 239/346 |
| 3,196,479 | A * | 7/1965 | Romoser | 401/208 |
| 3,672,546 | A | 6/1972 | Ruhle | |
| 3,744,922 | A * | 7/1973 | Fears | 401/190 |
| 4,087,022 | A | 5/1978 | Zanetti-Streccia | |
| 4,226,340 | A | 10/1980 | Troesch | |
| 4,420,099 | A | 12/1983 | Pizzurro et al. | |
| 4,720,046 | A * | 1/1988 | Morane | 239/343 |
| 6,113,008 | A | 9/2000 | Arsenault | |
| 6,953,299 | B2 * | 10/2005 | Wang et al. | 401/279 |
| 7,007,338 | B2 * | 3/2006 | Garabedian et al. | 15/231 |

FOREIGN PATENT DOCUMENTS

| | | | |
|---|---|---|---|
| BE | 897110 | A2 | 10/1983 |
| DE | 102005010191 | A | 9/2006 |
| EP | 1762509 | A | 3/2007 |
| FR | 1540500 | A | 9/1968 |
| GB | 1163573 | A | 9/1969 |

OTHER PUBLICATIONS

English Language Abstract for DE102005010191 taken from esp@cenet.com.
English Language Abstract for BE897110 taken from esp@cenet.com.
English Language Abstract for FR1540500 translated from Google Translations.

* cited by examiner

*Primary Examiner* — Michael Barr
*Assistant Examiner* — Benjamin L Osterhout
(74) *Attorney, Agent, or Firm* — Norris McLaughlin & Marcus PA

(57) ABSTRACT

The invention relates to a device for cleaning carpets, fabric and upholstery. More specifically, the invention relates to the use of pressurized aerosol containers for cleaning carpets, fabric and upholstery.

15 Claims, 4 Drawing Sheets

CLEANING DEVICE

This is an application filed under 35 USC 371 of PCT/GB2007/003701.

The invention relates to a device for cleaning carpets, fabric and upholstery. More specifically, the invention relates to the use of pressurised aerosol containers for cleaning carpets, fabric and upholstery.

Fabric and carpet fibres are easily stained on contact with various soils such as perfumes, particulate matter, grease, oil, wine, food remains, etc. Such stains are generally removed by compositions containing combinations of cleansing agents. In addition to conventional cleansing compositions such as fabric detergent powders, washing up liquid, floor cleaners, all of which may be suitable for use in cleaning stains from fabric and carpet, specialised carpet and upholstery cleaning compositions and devices have been developed.

U.S. Pat. No. 4,780,100 discloses foaming aqueous aerosol fabric cleaning composition for use in cleaning of carpets. U.S. Pat. No. 4,561,992 discloses an aerosol cleaning agent for textile surfaces that contains plasticized urea formaldehyde resin foam particles in addition to propellant and other ingredients. The product is applied to textile upholstery, allowed to dry, then vacuumed away from the fabric. U.S. Pat. No. 4,013,595 discloses a non-flammable aqueous aerosol rug cleaner using hydrocarbon propellants. JP 01-284299 discloses an aerosol container with a highly flammable stain removing liquid, where the aerosol is furnished with a stain removing tool furnished with bristles. Such foaming cleaning compositions have a number of disadvantages. The foams may contain high proportions of air, which can result in an incomplete contacting of stain with the product and thus lead to sporadic cleaning. Moreover, foam which is not completely removed from the surface can form residues which are undesirable and require additional cleaning. A further disadvantage is that the bulk of the foam may prevent the composition from effectively penetrating through carpet or fabric fibre.

A number of documents (DE 897110 A2, GB-A-2,181,489, U.S. Pat. No. 4,226,340, U.S. Pat. No. 4,426,025 and JP 08196954 A) disclose aerosol devices provided with shrouds which surround the aerosol nozzle. These can be used to contain the product being dispensed by the aerosol.

Although these could usefully be employed to some extent in a device for cleaning carpets, fabric and upholstery, they still suffer from a number of drawbacks. In particular, the product being dispensed would be dispensed directly downwardly onto the surface to be cleaned. The initially dispensed product would penetrate into the carpet, but may then hinder the remainder of the product from penetrating. This would lead to an inefficient use of the cleaning product, and does nothing to physically remove the dirt from the surface.

According to the present invention, there is provided a device for cleaning a surface comprising: a pressurised container containing a cleaning composition;

a nozzle through which the composition is arranged to be dispensed, in use, upon an actuation of a valve; and a shroud attached to the container and surrounding the nozzle;

the shroud having a hollow generally cylindrical portion adjacent to the nozzle for guiding the dispensed product in the direction in which it leaves the nozzle, and a flared portion at the end of the cylindrical portion furthest from the nozzle forming a spreading plate for guiding the dispensed product laterally when in contact, in use, with a surface to be cleaned.

The cylindrical portion and spreading plate ensure that the cleaning composition is dispensed from the nozzle and is guided laterally across the surface to be cleaned. This effectively provides a flow of cleaning composition through the surface to be cleaned, rather than simply directing the cleaning composition down onto the surface. This is beneficial as not only is the cleaning composition supplied to the surface to be cleaned constantly replenished, (i.e., the initially dispensed composition does not obstruct subsequently dispensed product being dispensed composition), but also the flow of composition entrains the dirt thereby effectively physically dispersing it from the surface.

The spreading plate may have any suitable shape. It may, for example, be rectangular and positioned to one side of the cylindrical portion. However, it is preferably annular and centred on the cylindrical portion. This is the most efficient arrangement as it can spread the cleaning composition evenly in all directions. In such an arrangement, the shape of the shroud resembles the end of a trumpet.

In the broadest sense, the device may be configured so that the spreading plate bears directly on the surface to be cleaned. This could be suitable for use in a carpet in which the cleaning composition can pass through the pile of the carpet. However, it is preferable to provide a spacer to maintain a predetermined distance between the spreading plate and the surface to be cleaned.

In the broadest sense, the cleaning composition may simply be left to spread as far as its momentum allows. This allows any dirt to be spread over a reasonably wide area. Under other circumstances, it may preferable to provide an annular lip surrounding the spreading plate to confine the cleaning composition. The annular lip may be the same component as the spacer.

The nozzle may be actuated by any suitable mechanism. However, preferably, it is arranged to be actuated by movement of the shroud towards the container. The user can simply grasp the container and push the shroud onto the surface of to be cleaned to operate the device.

The cleaning composition can be left in the surface for subsequent removal by the user, for example, by brushing a carpet or washing the fabric which has been treated with the cleaning composition.

However, preferably, the device is provided with a reservoir, and the nozzle and shroud are configured so that, in use, the cleaning composition is directed across the surface to be cleaned and into the reservoir. Such a device is extremely convenient for a user who simply places the device over the stain on a surface to be cleaned, and actuates the nozzle, for example, by pushing the container towards the shroud. This causes the cleaning composition to be dispensed out of the nozzle, through the hollow generally cylindrical portion, across a space between the spreading plate and the surface to be cleaned and into the reservoir.

The reservoir is preferably provided with a means for retaining the cleaning composition within the reservoir. This may take the form of an absorbent pad which soaks up the composition. It may be a tortuous path configured generally only to allow flow into the reservoir. Alternatively, the reservoir may be provided with a closure member. The closure member may be a separate member. However, the current preference is that the shroud is relatively movable with respect to the reservoir and is biased with respect to the reservoir, such that, when the device is removed from the surface, it moves relatively to the shroud to close the reservoir.

The reservoir may be positioned to one side of the spreading plate. However, the most efficient way of ensuring that the cleaning composition is properly directed into the reservoir is for the reservoir to be an annular chamber which is positioned above the spreading plate and around the hollow cylindrical portion.

When the device with the reservoir is activated, the flow of cleaning composition is directed into the reservoir. Preferably, therefore, the reservoir is provided with at least one vent to allow the reservoir to fill without unwanted pressure build-up. The vent may take the form of one or more small holes positioned out of the region of the main flow of the cleaning composition. The or each vent may be provided with a ball valve to prevent the cleaning composition from escaping.

The reservoir may be made big enough so that it can hold a number of doses of the cleaning composition. Alternatively, it may be removable from the device to allow the reservoir to be emptied. Alternatively, the reservoir may be provided with a cleaning composition outlet which is openable to empty the cleaning composition from the reservoir.

At least a portion of the reservoir may be translucent to allow the user to see the dirt which has been removed from the surface, and to gauge when the reservoir requires emptying.

Examples of devices in accordance with the present invention will now be described with reference to the accompanying drawings, in which.

Figure 1:
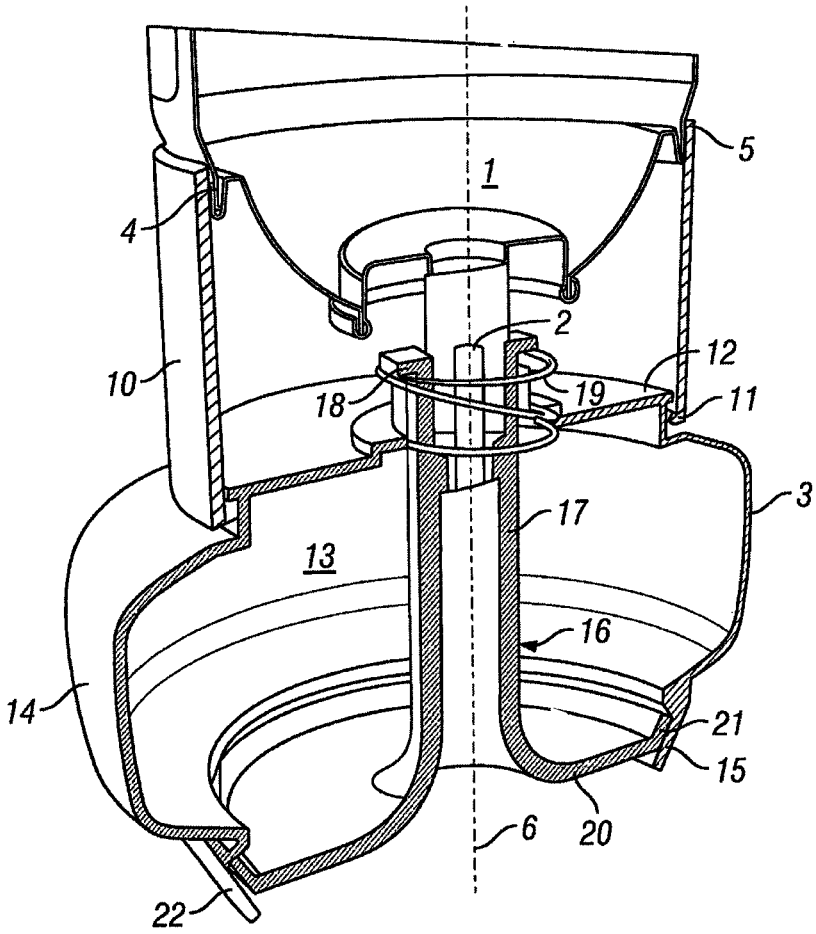
FIG. 1 is a cut away perspective view of a bottom part of a first device.

The cleaning device is arranged to dispense a cleaning composition from a pressurised container. The cleaning composition and pressurised container are as follows:—

Cleaning Composition

The cleaning composition to be used is a liquid with a kinematic viscosity (as measured by capillary viscometer) at 25° C. of 10000 $mm^2sec^{-1}$ or less, preferably 3000 $mm^2sec^{-1}$ more preferably 1000 $mm^2sec^{-1}$ or less. These preferred viscosities ensure that the composition penetrates soft surfaces such as fabric, upholstery and carpet, readily lifting soil.

The composition of the cleaning composition, as detailed below, does not include in the calculation of percentage by weight any propellant which may be dissolved or dispersed in the cleaning composition when the composition is placed along with propellant in the pressurised container.

The cleaning composition is preferably an aqueous composition, by which it is meant that it comprises 60% or more by weight of water, preferably 70% or more, more preferably 80% or more. Suitably the composition comprises less than 99% by weight of water.

Preferably, the cleaning composition is a non-foaming composition. By this, it is meant that any foam generated when the composition is agitated is unstable and collapses within 1 minute of ending agitation, preferably within 30 seconds, more preferably within 10 seconds. This may be suitably measured by placing 100 ml of composition in a 500 ml beaker and whisking it for 30 seconds with a food mixer. Where necessary, the cleaning composition may comprise an anti-foaming agent, such as a polydialkylsiloxane oil, at a level from 0.1 to 2% by weight, preferably 0.2 to 1% by weight, in order to suppress foaming.

The cleaning composition suitably comprises one or more cleaning agents selected from but not limited to surfactants, solvents, enzymes, bleaching agents, germicidal agents, polymers and chelating agents.

The cleaning composition suitably comprises from 0.05 to 10% by weight of surfactant selected from anionic surfactant, cationic surfactant, amphoteric surfactant, zwitterionic surfactant, non-ionic surfactant and mixtures thereof. Suitable surfactants for use as cleaning agents are present at a level to aid in soil removal without generating excessive foam. Preferred are non-ionic surfactants, particularly alcohol alkoxylates. Particularly preferred are the low-foaming ethoxylate/propoxylate non-ionic surfactants.

An organic solvent may be present as 0.1 to 10% by weight of the cleaning composition, preferably 0.2 to 6%, more preferably 0.3 to 4%.

Suitable organic solvents include, but are not limited to alcohols such as methanol, ethanol, propanol, isopropanols, n-butanol, t-butanol, isobutanol; glycols, (poly)ethylene glycol(s), glycol ethers, (poly)propylene glycol(s); ethylene, diethylene propylene, dipropylene and tripropylene glycol ethers (such as methyl, propyl or butyl ethers), hexylcellosolves, butylcellosolves, methylcellosolves, esters, glycol ether esters ketones and mixtures thereof.

The cleaning composition may suitably comprise from 0.1 to 10% by weight of a bleaching agent, preferably from 0.3 to 6%, more preferably from 0.5 to 4%. Suitable bleaching agents are water-soluble peroxides such as hydrogen peroxide, sodium perborate and sodium percarbonate, or mixtures thereof. A preferred bleaching agent is hydrogen peroxide.

The cleaning composition may also suitably comprise from 0.1 to 5% by weight of a germicidal agent, preferably a cationic germicidal agent.

The cleaning composition may also suitably comprise from 0.1 to 8% by weight of a chelating agent, such as citric acid and/or its alkali metal salts, or EDTA (ethylene diamine tetraacetic acid and/or its alkali metal salts). Such chelating agents are advantageous in breaking alkali earth or heavy metal ion bridges and so enhancing stain and soil removal characteristics of the cleaning composition.

Pressurised Container

The cleaning composition is stored in and suspended from a pressured, corrosion resistant container 1 that is equipped with a nozzle 2 having a discharge orifice so that a jet of the composition can be directed at the surface to be cleaned. Suitable containers or dispensers are known as aerosol containers and include a sealed chamber where a cleaning fluid and propellant are stored, and a hollow stem or tube having a distal end located within the chamber and a proximal end outside. The proximal end is connected to a nozzle through a valve which must be actuated in order for dispensing of the cleaning composition to occur, the nozzle having an orifice appropriately dimensioned to provide a jet of cleaning composition having an approximately conical distribution pattern, wherein the semi-angle of the cone is suitably 20° or less, preferably 15° or less, more preferably 10° or less.

The flow of cleaning composition through the nozzle is regulated by a valve that is pressure activated. It is preferred that the valve is actuated by a force applied to the nozzle in the direction from the nozzle end towards the body of the pressurised container. Suitable valves for use in the devices of the invention include valves such as the Koh-I-Noor™ PU foam valve VAV-1 with a 4 mm outlet diameter and the Lindal™ group PU45 valve with 4 mm outlet diameter.

Preferably, the valve is a metered valve, by which it is meant that when the valve is activated, it opens for a predetermined time to release a jet of cleaning composition, then closes. This gives the advantage of preventing the user from inadvertently firing an excessive volume of cleaning composition at the surface to be cleaned so that the surface becomes wetted excessively.

The pressurised container is pressurised with a gaseous component generally known as a propellant. Preferred propellants for use in the invention are compressed air, nitrogen, carbon dioxide, other inert gasses, or hydrocarbons such as isobutene, butane 40, butane 70 or dimethyl ether.

In an alternative embodiment of the invention, the pressurised container may be of the type where a manually operated pump is used to provide an overpressure inside the container, by pumping air into the container to act as a propellant.

An alternative type of pressurised container that may be employed in the devices in the invention, includes a barrier or bag that separates the cleaning composition from the propellant. Such "bag in can" pressurised containers are described in U.S. Pat. No. 4,260,110. These have the advantage that the dispensing of cleaning composition from the pressurised container is independent of the orientation of container. These also have the advantage that they overcome any incompatibility problems between the propellant and the cleaning composition, as these are kept separate by the barrier or bag.

The pressurised container is such that when the valve is fully opened so that flow of the cleaning composition and propellant takes place through the nozzle, the discharge rate of the composition (including any propellant) is suitably from 20 to 100 gm/second, preferably from 25 to 80 gm/second, more preferably from 30 to 60 gm/second. Such discharge rates given an effective penetration into the surface to be cleaned, while not leading to over rapid discharge and emptying of the pressurised container, such that the pressurised container may be small enough for easy handling yet contain enough cleaning composition for several treatments.

The pressurised container 1 is preferably attached to an applicator head 3 by an attachment means such that when the pressurised container is empty or nearly empty of cleaning composition and/or propellant, it can be easily replaced by the user. It is preferred that the applicator head is re-usable while the pressurised container is disposable.

The pressurised container is suitably provided with a lip or rim 4 around its perimeter towards the nozzle end of the container. This allows for engagement with an attachment means such as a resilient groove or collar or lip 5 on the interior surface of the cleaning head of the device, whereby the applicator head of the device can be firmly yet removably attached to the pressurised container. In other embodiments, the pressurised container may be furnished with other attachment means, such as a male screw thread which may engage with a female threaded collar on the applicator head.

Preferably, the nozzle of the pressurised container, situated at the distal end of the container, is arranged such that when the valve is opened, the jet of cleaning composition is fired substantially along the long axis 6 of the pressurised container, i.e. in a direction normal to the end plate of the pressurised container, into the entrance orifice of the applicator head.

Applicator Head

The comments above with regard to the cleaning composition and pressurised container apply to all of the examples set out below. The various different applicator heads will now be described.

The applicator head of FIG. 1 has a collar 10 which is provided with the lip 5 for attachment to the pressurised container 1. At the opposite end of the collar 10 is a second lip 11 which engages with a plate 12 forming a part of a reservoir 13. The reservoir 13 is defined by the end plate 12 and a reservoir housing 14 which terminates at its lower edge in a downwardly depending annular lip forming a containment ring 15. Within the reservoir 13 is a shroud 16 which has a hollow cylindrical portion 17 which extends from the nozzle 1 surrounding the axis 6. The cylindrical portion 17 terminates at its upper edge in an annular flange 18. A compression spring 19 is positioned between this lip 18 and the plate 12 of reservoir 13 so as to bias the shroud 16 in the closed position as described below.

At the opposite end of the shroud 16 is a flared portion 20 giving the shroud 16 a trumpet-like configuration. The outer edge of the flared portion 20 terminates in an upturned annular lip 21. In the biased configuration, the lip 21 is biased against a shoulder 22 on the reservoir housing 14 such that the reservoir 13 is closed.

The device will normally be stored the opposite way up to the arrangement shown in FIG. 1 and will be inverted by a user prior to use. The bottom end of the reservoir 13 may be closed by a cap 23 (see FIG. 3) which is removed before use.

In the orientation shown in FIG. 1, the user grasps the container 1 and presses the containment ring 15 over the stained surface. Further downward pressure on the container causes the nozzle 2 to push the shroud 16 downwardly. This opens up a gap between lip 21 and shoulder 22 as shown in FIG. 1. When the shroud hits a stop or the surface to be cleaned, further downward movement of the container causes the shroud 16 to press on nozzle 2 to dispense the cleaning product. The cleaning product is dispensed downwardly from the nozzle 2 along the cylindrical portion 17 of the nozzle 16. Once it reaches the end of this portion, it is guided radially outwardly between the surface to be cleaned and the flared portion 20 until it encounters the containment ring 15 which generally reverses its direction and causes it to flow inwardly over the lip 21 into the reservoir 13 where it is collected.

The user then removes the downward pressure from the container whereupon the spring 19 biases the shroud in a downward direction so that the lip 21 abuts the containment ring 15 thereby sealing the reservoir and preventing the cleaning composition from escaping from the reservoir.

The reservoir can then be emptied by removing it from the device, or using one of the subsequently described methods.

The reservoir may be translucent to allow the user to see how much cleaning composition has been used and also to allow them to have a visual indication of its effectiveness.

Figure 2:
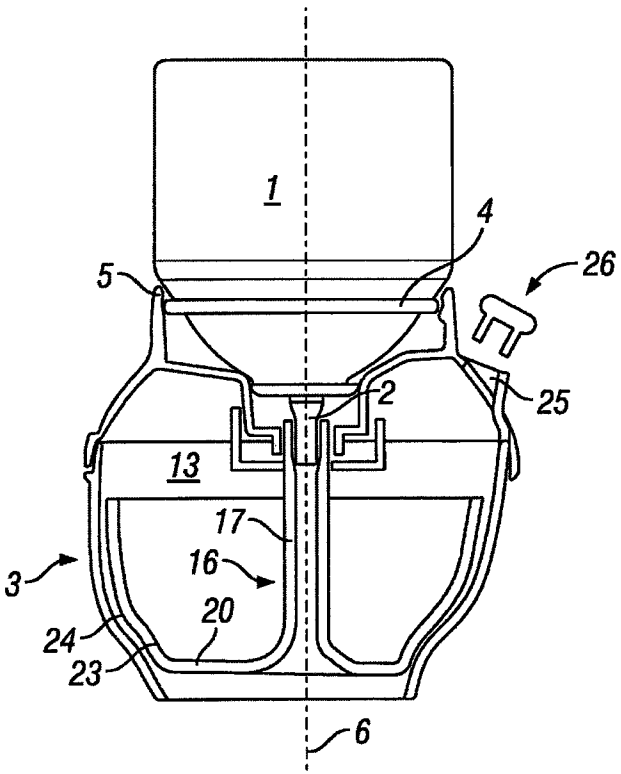
FIG. 2 is a cross-section through the bottom part of a second device.

The arrangement shown in FIG. 2 is broadly the same as that described in relation to FIG. 1 and the same components have been designated the same reference numerals. The second example does not have a spring. Instead, the reservoir is effectively closed by virtue of the fact that the flared portion 20 extends into an upwardly extending wall 23 which closely follows the inner wall of the reservoir 13 so as to form a cup-like inner portion for storing the cleaning composition and a narrow annular pathway 24 between the reservoir 13 and wall 23. In use, there is no relative movement between the shroud 16 and reservoir 13. Instead, the nozzle 2 simply pushes down on the top edge of the cylindrical portion 17 to discharge the cleaning composition. This discharges along the cylindrical portion 17, between the surface to be cleaned and the flared portion 20, along the passage 24 and into the cup-like inner portion of the reservoir 13 as defined by the wall 23. Alternatively, the shroud 16 and reservoir 13 could be movable relatively to one another and biased by a spring to ensure that the reservoir is fully closed between operations.

The device must be kept generally in the configuration shown in FIG. 2 to avoid spillage. The top end of the reservoir 13 is provided with an outlet 25 which is closed by a plug 26. To empty the reservoir, the plug 26 is removed and the cleaning composition is poured out of the reservoir 13.

Figure 3:
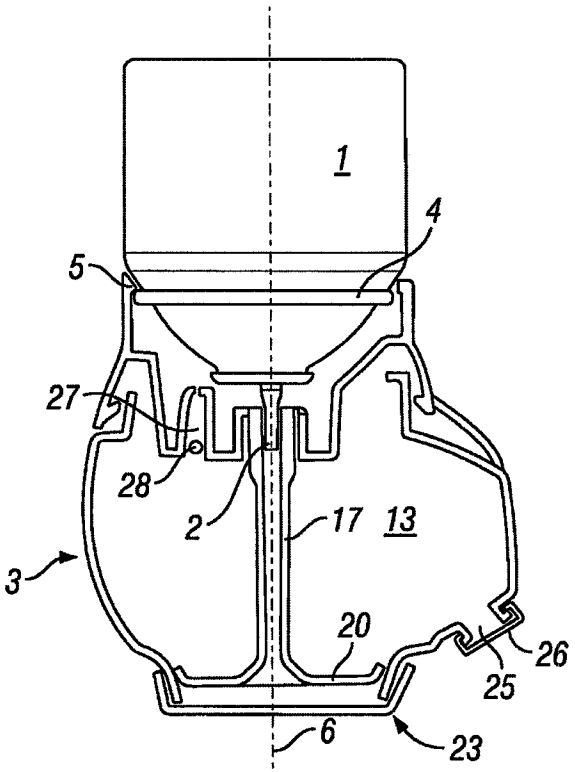
FIG. 3 is a cross-section through a bottom part of a third device.

The example in FIG. 3 is similar to the example of FIG. 1, but has a number of modifications which may be applied to the FIG. 1 example.

The cap 23 which closes the bottom end of the reservoir has already been described.

A vent 27 is provided at the top of the reservoir. This allows the air in the reservoir 13 to escape during filling. A ball 28 is contained within the vent 27. If the container is inverted from the portion shown in FIG. 3, the ball will prevent the cleaning composition which remains in the reservoir from leaking out. More than one such vent and ball may be provided.

Similarly to the example of FIG. 2, the reservoir of FIG. 3 also has an outlet 25 and plug 26 allowing the reservoir to be emptied, this time without the need to invert the device from the position shown.

The lip of the reservoir extends slightly below the bottom of the flared portion 20. When applied to a compressible surface such as a carpet, the lip presses into the surface and the flared portion can still be pushed up by contact with the surface.

Figure 4:
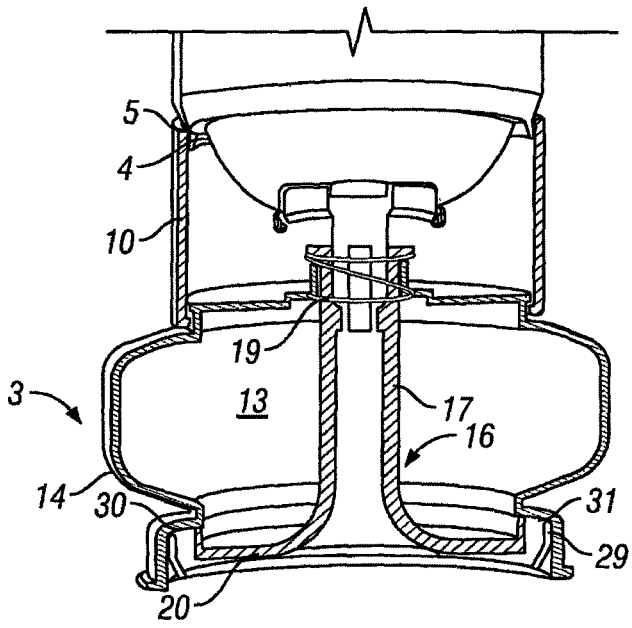
FIG. 4 is a cut away perspective view of a bottom part of a fourth device.

The example of FIG. 4 has the same type of spring activated mechanism shown in FIG. 1. The only difference is in relation to the nature of the containment ring 15. In FIG. 1, the containment ring was a part of the reservoir housing 14. However, in FIG. 4, the containment ring 29 is attached to the flared portion 20 of the shroud to a plurality of radially outwardly extending spokes 30. The wall 14 of the reservoir 13 extends around the containment ring 29 to protect the shroud. An upwardly extending lip 31 at the radially outermost edge of the flared portion 20 provides a seal against the reservoir housing 14 in the unreleased condition.

To activate the device, downward pressure is applied to the container 1 which pushes the shroud 16 towards the surface to be cleaned. This opens up the pathway around the top of the upwardly extending lip 31. Further downward pressure causes the shroud 16 to press on the nozzle 2 to dispense the cleaning product. This travels along the cylindrical portion 17 between the flared portion 20 and the surface to be cleaned and up over the lip 31 into the reservoir 13.

Figure 5A:
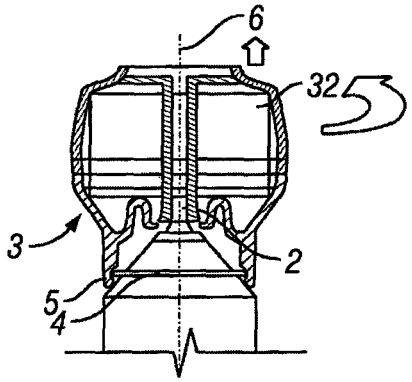
FIG. 5A is a cut away cross-section of the bottom part of a fifth device (with the device being shown in an inverted configuration)
Figure 5B:
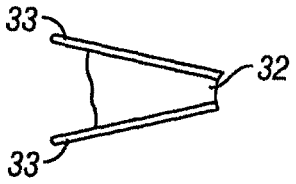
FIG. 5B is a plan view of the sponge for use in FIG. 5A in a collapsed configuration.
Figure 5C:
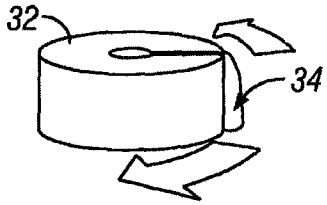
FIG. 5C is a perspective view of the sponge in an expanded configuration.

In the arrangement shown in FIGS. 5A to 5C, a sponge 32 or other absorbent element is provided in the reservoir 13. This can be supplied in the configuration shown in FIG. 5B in which the sponge portion is compressed between two end plates 33. The end plates 33 are moved apart circumferentially to form the annular configuration shown in FIG. 5C. The radially outermost parts of the plates 33 provide handles 34 allowing the sponge to be moved in and out of the reservoir 13. A part of the reservoir housing and the shroud are made detachable to allow the sponge to be removed. The sponge may be squeezed out by moving the end plates back towards the compressed configuration of FIG. 5B or it may be replaced with a new sponge.

All of the reservoir housings described to date may be manufactured by blow moulding or other well-known moulding techniques. Certain other components which have been described as being separate components, for example the collar 10 and the reservoir housing 14, may in practice be moulded as a single component.

Figure 6A:
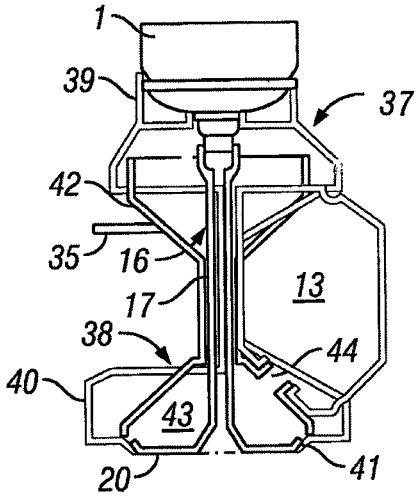
FIGS. 6A to 6C are schematic cross-sections showing the operation of a sixth device.
Figure 6B:
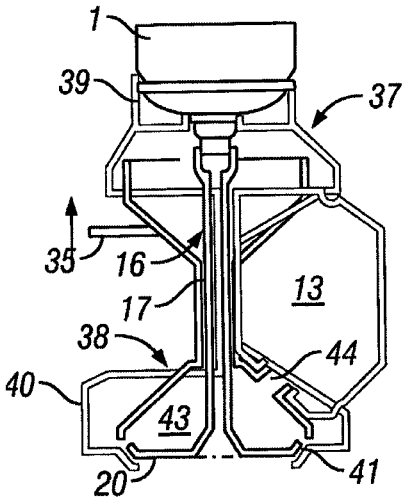
Figure 6C:
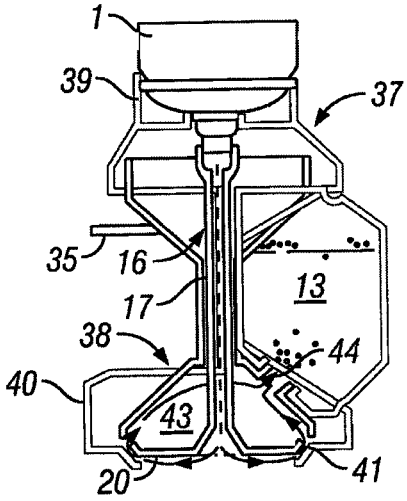

The sixth device is shown in FIGS. 6A-6C. By contrast with the previous examples, this device is not designed to be operated by downward pressure on the container 1. Instead, the device is operated by upward pressure on the lever 35.

The structure shown in FIGS. 6A-6C has three main components. An outer casing 37, a reservoir 13 and the lever mechanism 38. The outer casing 37 has an upper portion 39 which is a snap-fit around a lip on the container 1. The outer case extends downwardly around the central portion of the lever mechanism 38 and terminates in a lower portion 40 which supports the lower end of the lever mechanism 38. The lower portion 40 has a downwardly depending lip 41 which co-operates with the flared portion 20 of shroud 16 in order to seal the bottom of the device in a similar manner to that described in the earlier examples.

The lever mechanism 38 consists of the shroud 16 connected to a surrounding portion 42 by a number of spokes (not shown). The surrounding portion 42 serves a number of functions. Firstly, it co-operates with the outer casing 37 which supports it, to allow relative movement with respect to the container 1. Secondly, it provides a support for the lever 35, and thirdly it provides annular passage 43 which directs the cleaning product which flows around the flared portion 20 towards an opening 44 in the reservoir 13.

The reservoir 13 is mounted on the lever housing 38 and moves with the lever housing 38 relatively to the outer casing 37. The reservoir 13 is shown only on the right-hand side of the Figures, but may be arranged to extend around most of the circumference of the device provided that sufficient room is available for the lever 35. The reservoir 13 is vented in the same way as the previous examples.

The operation of this device is as follows:—

The device is placed over the surface to be cleaned in the configuration shown in FIG. 6A with the flared portion 20 resting on the surface. The user then pushes the lever 35 upwardly (as shown in FIG. 6B) which then pushes the lever mechanism 38 upwardly. This opens an annular space between the flared portion 20 and the lip 41 and activates dispensing of the cleaning product. The cleaning product travels through the surface to be cleaned through the gap between the flared portion 20 and lip 41, into the annular chamber 43, through the opening 44 (via a one-way valve—not shown) and into the reservoir 13 as shown in FIG. 6C. The user then pushes the lever 35 downwardly so that the lever housing 38 returns to the closed position of FIG. 6A. Alternatively, the lever housing 38 is spring loaded so that it returns to the FIG. 6A position on release of the lever 35.

The reservoir 13 may be detachable or may be provided with a closable spout to allow the reservoir 13 to be emptied.

The invention claimed is:

1. A device for cleaning a surface comprising:

a pressurised container containing a cleaning composition;

a nozzle through which the composition is arranged to be dispensed, in use, upon an actuation of a valve;

a reservoir; and a shroud attached to the container and surrounding the nozzle;

the shroud having a hollow generally cylindrical portion adjacent to the nozzle for guiding the dispensed cleaning composition in the direction in which it leaves the nozzle, and a flared portion at the end of the cylindrical portion furthest from the nozzle forming a spreading plate for guiding the dispensed cleaning composition laterally when in contact, in use, with a surface to be cleaned and wherein the nozzle and shroud are configured so that, in use, the cleaning composition is directed across the surface to be cleaned and into the reservoir.

2. A device according to claim 1, wherein the spreading plate is annular and centered on the cylindrical portion.

3. A device according to claim 1, further comprising a spacer to maintain a predetermined distance between the spreading plate and the surface to be cleaned.

4. A device according to claim 1 wherein the device includes a containment ring which surrounds the spreading plate which containment ring is adapted to confine the cleaning composition.

5. A device according to claim 3, wherein the containment ring is the same component as the spacer.

6. A device according to claim 1, wherein the nozzle is arranged to be actuated by movement of the shroud towards the container.

7. A device according to claim 1, wherein the reservoir is provided with a means for retaining the cleaning composition within the reservoir.

8. A device according to claim 7, wherein the means for retaining the cleaning composition is an absorbent pad which absorbs the composition.

9. A device according to claim 7, wherein the means for retaining the cleaning composition within the reservoir comprises a tortuous path configured generally only to allow flow into the reservoir.

10. A device according to claim 7, wherein the means for retaining the cleaning composition within the reservoir comprises a closure member.

11. A device according to claim 10, wherein the closure member is provided such that the shroud is relatively movable with respect to the reservoir and is biased with respect to the reservoir, such that, when the device is removed from the surface, it moves with respect to the shroud to close the reservoir.

12. A device according to claim 1, wherein the reservoir is an annular chamber which is positioned above the spreading plate and around the hollow cylindrical portion.

13. A device according to claim 1, wherein the reservoir is provided with at least one vent.

14. A device according to claim 13, wherein at least one vent is provided with a ball valve to prevent the cleaning composition from escaping.

15. A device according to claim 1, wherein the reservoir is provided with a cleaning composition outlet which is openable to empty the cleaning composition from the reservoir.

* * * * *